US008276868B2

(12) United States Patent
Chang

(10) Patent No.: US 8,276,868 B2
(45) Date of Patent: Oct. 2, 2012

(54) SEAT ADJUSTER FOR SPORTS EQUIPMENT

(75) Inventor: Shu-Chen Chang, Taoyuan County (TW)

(73) Assignee: Healthstream Taiwan Inc., Taoyuan County (TW)

( * ) Notice: Subject to any disclaimer, the term of this patent is extended or adjusted under 35 U.S.C. 154(b) by 0 days.

(21) Appl. No.: 12/749,737

(22) Filed: Mar. 30, 2010

(65) Prior Publication Data

US 2011/0133048 A1 Jun. 9, 2011

(30) Foreign Application Priority Data

Dec. 7, 2009 (TW) ..... 98222872 U

(51) Int. Cl.

| | |
|---|---|
| ***F16M 13/00*** | (2006.01) |
| ***F16M 11/00*** | (2006.01) |
| ***A47C 1/00*** | (2006.01) |
| ***A61G 15/00*** | (2006.01) |
| ***B60N 2/00*** | (2006.01) |
| ***B60N 2/02*** | (2006.01) |

(52) U.S. Cl. ..... 248/419; 248/157; 248/421; 248/423; 297/325; 297/326; 297/327; 297/238

(58) Field of Classification Search ..... 248/419, 248/157, 421, 423; 297/325, 326, 327, 328
See application file for complete search history.

(56) References Cited

U.S. PATENT DOCUMENTS 3,680,821 A * 8/1972 Barriere ..... 248/371
5,664,755 A * 9/1997 Gruber ..... 248/424
5,676,424 A * 10/1997 Winkelhake ..... 297/337
5,882,061 A * 3/1999 Guillouet ..... 296/65.05
6,176,459 B1 * 1/2001 Wilcox et al. ..... 248/371
6,398,304 B1 * 6/2002 Chen et al. ..... 297/327
6,488,337 B1 * 12/2002 De Voss et al. ..... 297/344.13
6,902,234 B2 * 6/2005 Becker et al. ..... 297/216.1
7,517,020 B2 * 4/2009 Yokota ..... 297/344.15
2003/0213885 A1 * 11/2003 Schumann et al. ..... 248/419
2003/0230695 A1 * 12/2003 Becker et al. ..... 248/419
2006/0278774 A1 * 12/2006 Garnier et al. ..... 248/157

* cited by examiner

*Primary Examiner* — Terrell McKinnon
*Assistant Examiner* — Christopher Garft
(74) *Attorney, Agent, or Firm* — Browdy and Neimark, PLLC

(57) ABSTRACT

A seat adjuster for an article of sports equipment includes a base, a locating frame pivotally connected with the base for connection of a seat, a first locating plate mounted with the base, and a second locating plate pivotally connected with the locating frame so as to be pivotable between a first position where a second teeth portion of the second locating plate is engaged with a first teeth portion of the first locating plate such that the locating frame can't be pivotable relative to the base for fixing the seat in position, and a second position where the second teeth portion of the second locating plate is disengaged from the first teeth portion of the first locating plate such that the locating frame can be pivotable relative to the base for allowing the angle of inclination of the seat to be adjustable.

12 Claims, 7 Drawing Sheets

SEAT ADJUSTER FOR SPORTS EQUIPMENT

BACKGROUND OF THE INVENTION

1. Field of the Invention

The present invention relates generally to sports equipment, and more specifically to a seat adjuster for sports equipment for the purpose of adjusting the angle of inclination of a seat.

2. Description of the Related Art

Currently, common fitness equipment is equipped with a seat that has a backrest for allowing a user to operate it comfortably. However, the seat with a fixed angle of inclination has failed to satisfy users of different statue, and thus a seat with an adjustable angle of inclination is indispensable to the fitness equipment so as to relieve the user's tiredness caused by improper operation, and prevent muscle strains or displacement of bones in the user's legs during long-term exercise, and provide good support and high comfort for the user.

Taiwan Patent Publication No. 200808405 discloses a seat back adjustment mechanism for an article of sports equipment, comprising an adjustment unit that can be turned toward a predetermined direction to increase friction among a first friction member, a second friction member, and a base for the purpose of adjusting the angle of inclination of a seat back.

According the aforesaid design, the first and second friction members may easily get damaged under the action of frictional force to shorten the working life of the seat back adjustment mechanism. Besides, the seat back adjustment mechanism needs to be equipped with a lot of components for providing enough friction to hold the seat back in position, causing complication of the whole structure and increasing the cost.

SUMMARY OF THE INVENTION

It is one objective of the present invention to provide a seat adjuster for sports equipment, which has a simple structure and low costs.

To achieve this objective of the present invention, the seat adjuster comprises a base, a locating frame pivotally connected with the base, a first locating plate mounted with the base and having a first teeth portion, a second locating plate having a second teeth portion and pivotally connected with the locating frame so as to be pivotable between a first position and a second position, and a control rod connected with the locating frame and engaged with the second locating plate for driving the second locating plate to be pivotally moved between the first position and the second position.

When the second locating plate is located at the first position, the second teeth portion of the second locating plate is engaged with the first teeth portion of the first locating plate such that the locating frame can't be pivotable relative to the base. When the second locating plate is located at the second position, the second teeth portion of the second locating plate is disengaged from the first teeth portion of the first locating plate such that the locating frame can be pivotable relative to the base.

As indicated above, the angle of inclination of a seat is adjustable by the pivotal movement of the locating frame for enabling the seat adjuster of the present invention to have the advantages of simple structure and low costs.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
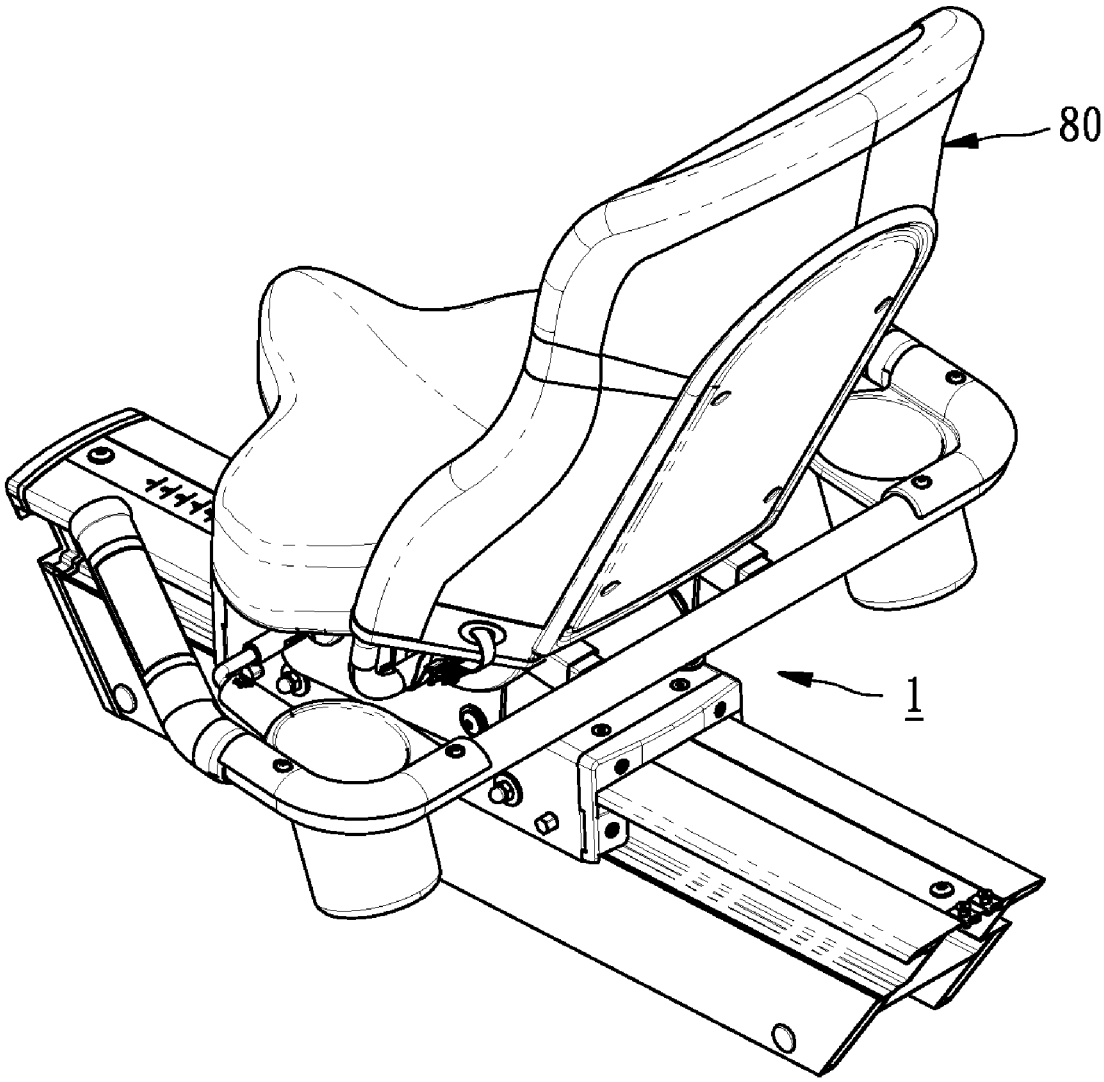
FIG. 1 is a perspective view of a seat adjuster according to a preferred embodiment of the present invention, showing the seat adjuster is assembled with the seat.
Figure 2:
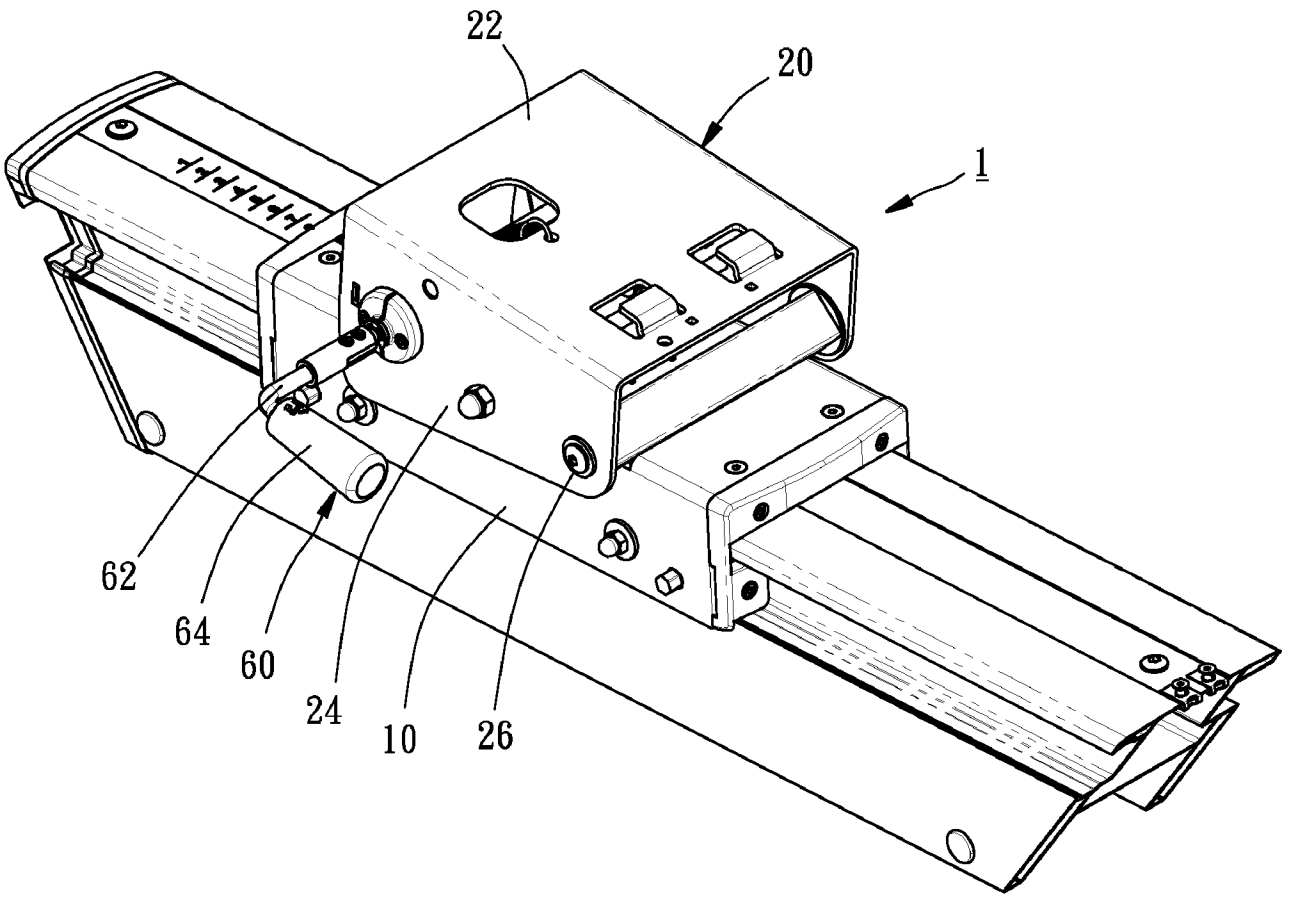
FIG. 2 is a perspective view of the seat adjuster according to the preferred embodiment of the present invention.
Figure 3:
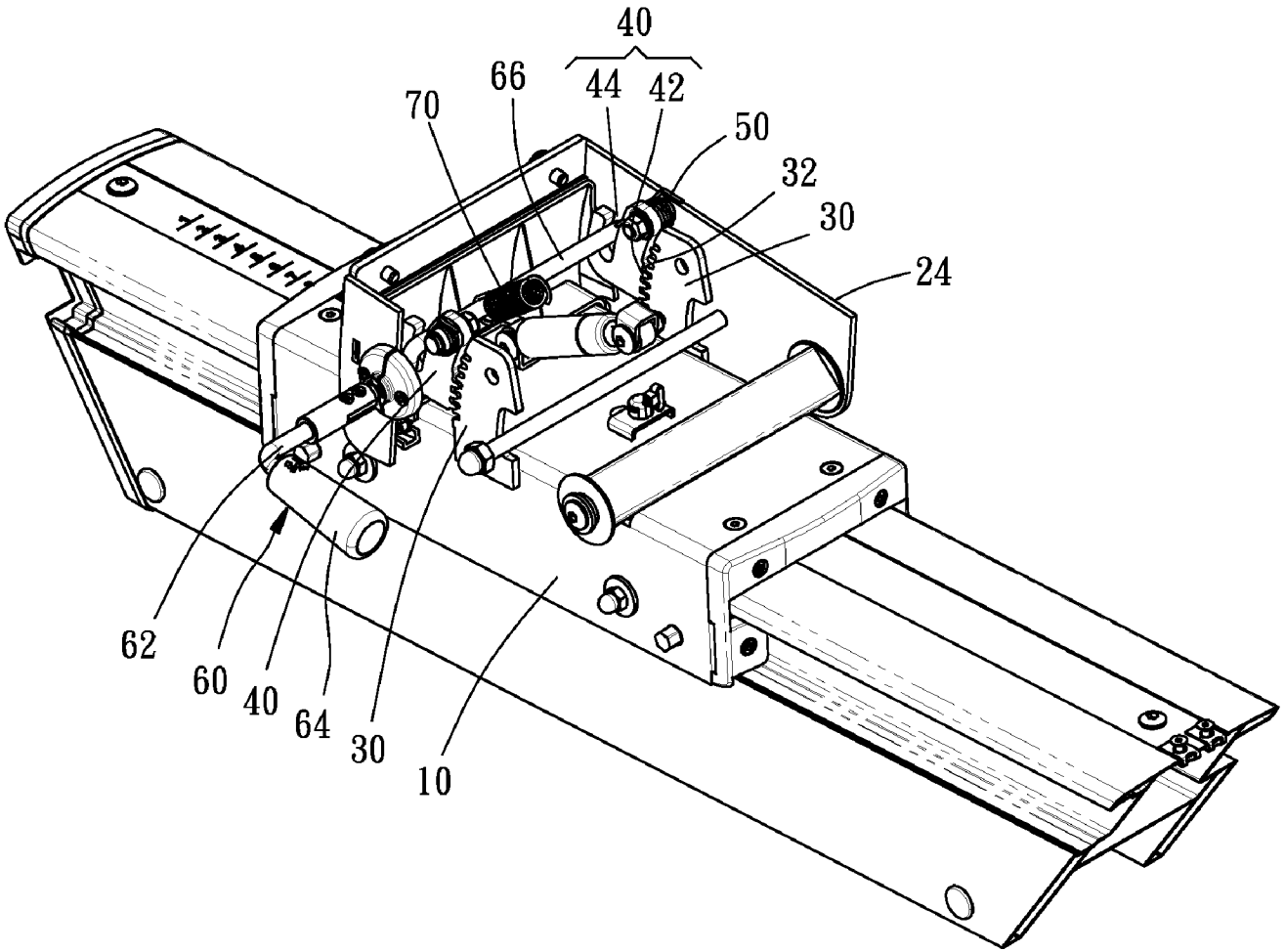
FIG. 3 is a perspective partial sectional view of the seat adjuster according to the preferred embodiment of the present invention.

Referring to FIGS. 1 to 3, a seat adjuster 1 for sports equipment in accordance with a preferred embodiment of the present invention comprises a base 10, a locating frame 20, two first locating plates 30, two second locating plates 40, two torsion springs 50, a control rod 60, and a tension spring 70.

Figure 4:
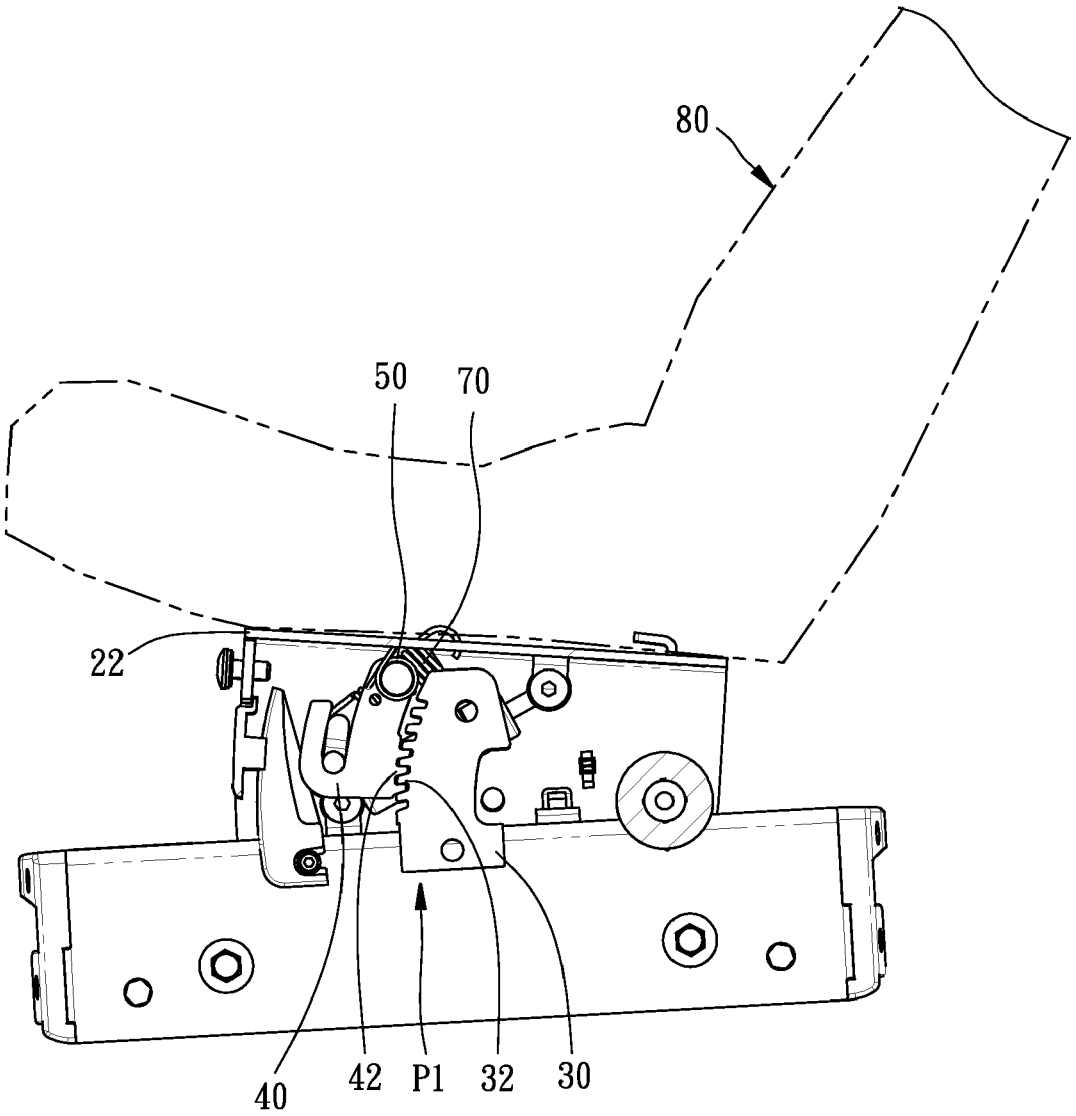
FIG. 4 is a lateral sectional view of the seat adjuster according to the preferred embodiment of the present invention, showing the second locating plate is located at the first position.

The locating frame 20 has a top wall 22 for connection of a seat 80, as shown in FIG. 4, and two opposite lateral walls 24 each having a top side extending from one of two opposite sides of the top wall 22 and a bottom side pivotally connected with one of two opposite sides of the base 10 through a pivot 26 such that the locating frame 20 is pivotable relative to the base 10.

Each of the first locating plates 30 is fastened to one of two opposite sides of the base 10 and located between the base 10 and one of the lateral walls 24 of the locating frame 20 and provided with a first teeth portion 32.

Figure 5:
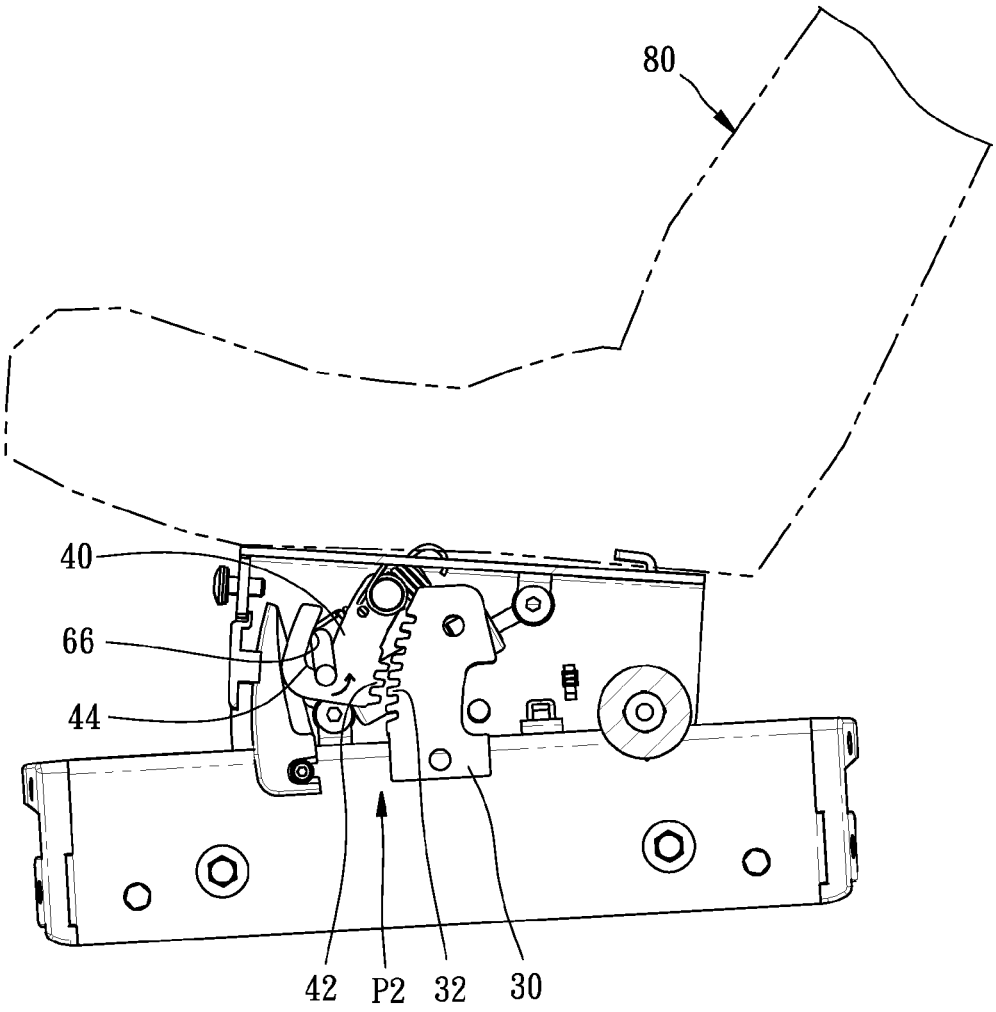
FIG. 5 is similar to FIG. 4, showing the second locating plate is located at the second position.

Each of the second locating plates 40 is pivotally connected with an inner surface of one of the lateral walls 24 of the locating frame 20 and provided with a second teeth portion 42 and a guide slot 44. When the second locating plate 40 is located at a first position P1, as shown in FIG. 4, the second teeth portion 42 of the second locating plate 40 is engaged with the first teeth portion 32 of the first locating plate 30 such that the locating frame 20 can't be pivotable relative to the base 10. When the second locating plate 40 is located at a second position P2, as shown in FIGS. 5, the second teeth portion 42 of the second locating plate 40 is disengaged from the first teeth portion 32 of the first locating plate 30 such that the locating frame 20 can be pivotable relative to the base 10.

Each of the torsion springs 50 is disposed between one of the lateral walls 24 of the locating frame 20 and one of the second locating plates 40 for providing a torsion to maintain the second locating plate 40 in the first position P1.

The control rod 60 has a L-shaped control section 62, a handle 64 sleeved on one end of the control section 62, and a L-shaped transmission section 66 extending from the other end of the control section 62 and passing through one of the lateral walls 24 of the locating frame 20 into the guide slots 44 of the second locating plates 40 and having a distal end pivotally connected with the other one of the lateral walls 24 of the locating frame 20. When the control rod 60 is driven to rotate by an external force, the transmission section 66 of the control rod 60 can push periphery walls of the guide slots 44 of the second locating plates 40 for driving the second locating plates 40 to be pivotally moved from the first position P1 to the second position P2.

The tension spring 70 has two ends respectively connected with the top wall 22 of the locating frame 20 and the transmission section 66 of the control rod 60 for applying a pulling force to the control rod 60, causing the reverse rotation of the control rod 60 and removing a pushing force applied to the second locating plates 40. Therefore, the second locating plates 40 can be pivotally moved from the second position P2 to the first position P1 through the torsion applied by the torsion springs 50.

Figure 6:
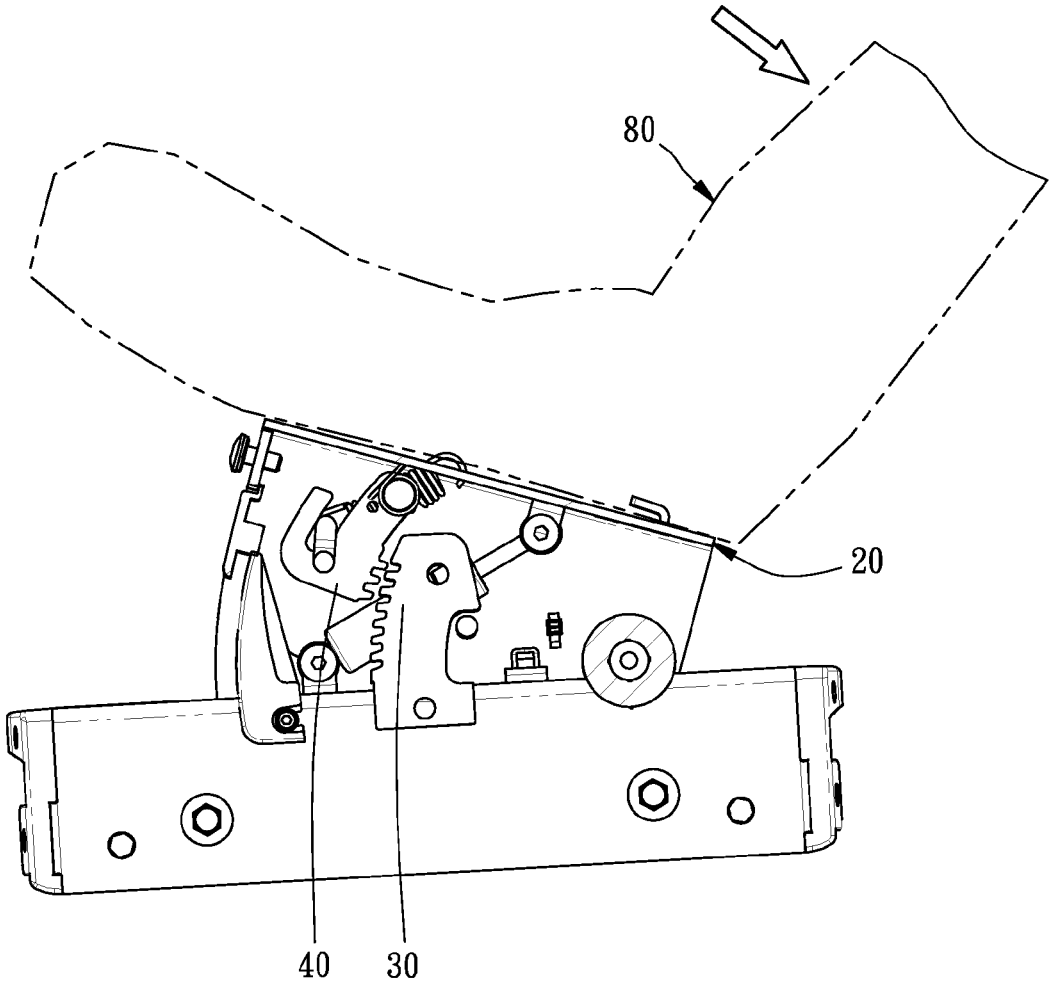
FIG. 6 is similar to FIG. 5, showing the seat is adjusted to a suitable angle of inclination when the second locating plate is located at the second position.
Figure 7:
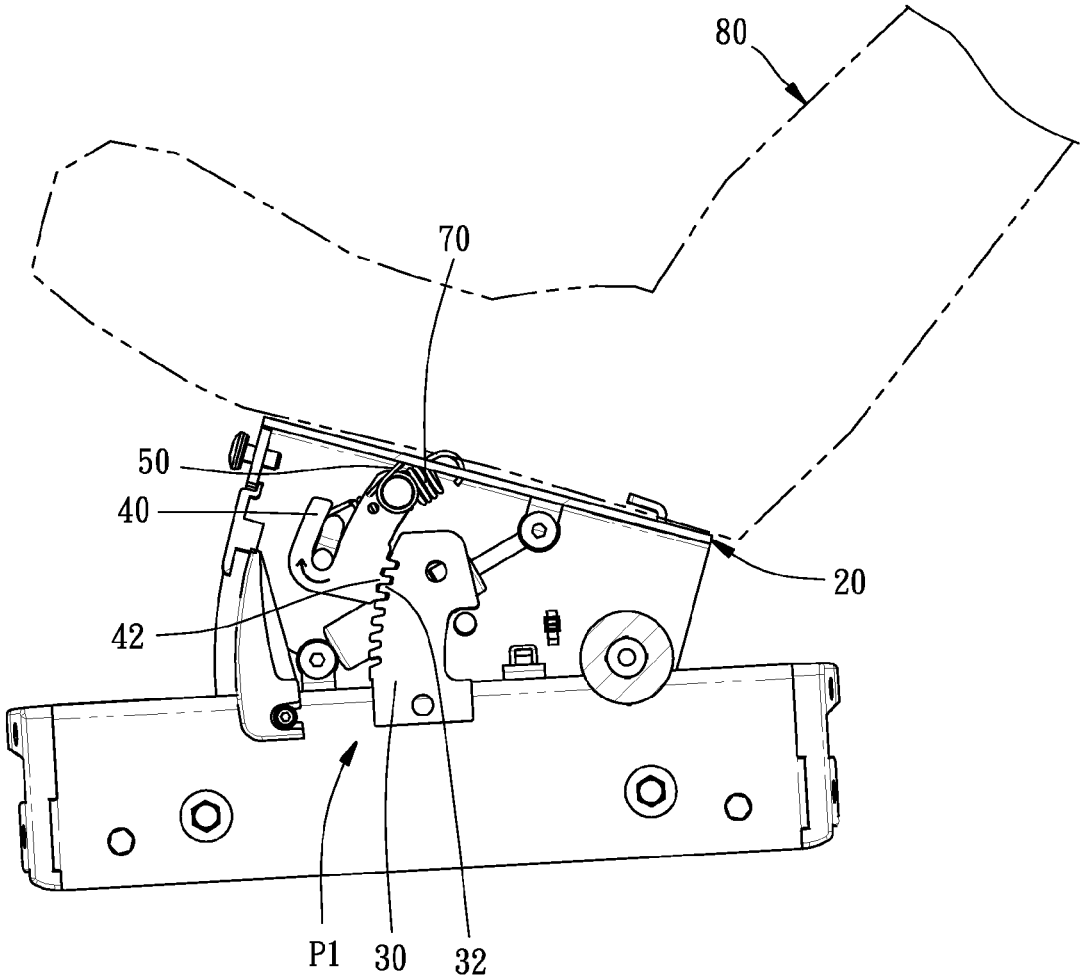
FIG. 7 is similar to FIG. 6, showing the seat is fixed when the second locating plate is located at the first position.

When adjusting the angle of inclination of the seat 80, a user holds the handle 64 to turn the control rod 60 in order to move the second locating plates 40 from the first position P1 to the second position P2, as shown in FIGS. 4 and 5, and then the user can apply a force to the seat 80 so as to adjust the angle of inclination of the seat 80 through the pivotal movement of the locating frame 20, as shown in FIG. 6. Once the seat 80 is adjusted to a suitable angle of inclination, the user can release the force applied to the control rod 60 such that the control rod 60 can be reversely rotated through the tension spring 70 to remove the pushing force applied to the second locating plates 40. Thereafter, the second locating plates 40 can be pivotally moved back to the first position P1 through the torsion springs 60, as shown in FIG. 7, thereby fixing the seat 80 to finish the angle adjustment work.

By means of the aforesaid, the seat adjuster of the present invention provides two locating plates that can be engagable with each other to adjust the angle of inclination of the seat, and has a more simple structure and lower costs than the prior art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A seat adjuster for sports equipment, the seat adjuster comprising:

a base (10);

a locating frame (20) pivotally connected with the base;

a first locating plate (30) mounted directly on the base (10) and having a first teeth portion (32);

a second locating plate (40) mounted directly on the locating frame (20) and having a second teeth portion (42) and pivotally connected with the locating frame (20) so as to be pivotable between a first position where the second teeth portion (42) of the second locating plate (40) is engaged with the first teeth portion (32) of the first locating plate (30) such that the locating frame is prevented from pivoting relative to the base, and a second position where the second teeth portion of the second locating plate is disengaged from the first teeth portion of the first locating plate such that the locating frame is pivotable relative to the base;

a rotatable control rod (60) pivotally connected with the locating frame (30) and engaged with the second locating plate (40) whereby the rotatable control rod drives and pivots the second locating plate (40) from the first position to the second position; and wherein the second locating plate (40) has a guide slot (44), and the rotatable control rod (60) has a horizontally extending L-shaped transmission section received in the guide slot (44) and pushes a peripheral wall of the guide slot (44), and is so constructed to drive the second locating plate (40) to pivotally move from the first position to the second position.

2. The seat adjuster as claimed in claim 1, wherein the locating frame includes a top wall and two lateral walls each having a top side extending from one of two opposite sides of the top wall and a bottom side pivotally connected with one of two opposite sides of the base; the first locating plate is located between the base and one of the lateral walls of the locating frame.

3. The seat adjuster as claimed in claim 2, wherein the first locating plate is two in number and mounted with one of two opposite sides of the base, and the second locating plate is two in number and pivotally connected with one of the lateral walls of the locating frame.

4. The seat adjuster as claimed in claim 1, further comprising at least one torsion spring disposed between the locating frame and the second locating plate.

5. The seat adjuster as claimed in claim 1, further comprising a tension spring having two ends respectively connected with the locating frame and the control rod.

6. The seat adjuster of claim 1, further comprising a handle (64) constructed to turn the locating plate to control the pivoting angle and engagement position of the locating plate.

7. A seat adjuster for sports equipment, the seat adjuster comprising:

a base (10);

a locating frame (20) pivotally connected with the base (10);

a first locating plate (30) mounted with the base (10) and having a first teeth portion (32);

a second locating plate (40) having a second teeth portion (42) and pivotally connected with the locating frame (20) so as to be pivotable between a first position where the second teeth portion (42) of the second locating plate (40) is engaged with the first teeth portion (32) of the first locating plate (30) such that the locating frame is prevented from pivoting relative to the base, and a second position where the second teeth portion of the second locating plate is disengaged from the first teeth portion of the first locating plate such that the locating frame is pivotable relative to the base;

a control rod (60) rotatably connected with the locating frame (20) and engaged with the second locating plate (40) and is so constructed to drive the second locating plate (40) to pivotally move from the first position to the second position; and wherein the second locating plate has a guide slot, and the rotatable control rod has a horizontally extending L-shaped transmission section received in the guide slot and pushes a peripheral wall of the guide slot, and is so constructed to drive the second locating plate to pivotally move from the first position to the second position;

a handle (64) connected to the control rod (60) which upon actuation turns the second locating plate (40) controlling the pivoting angle and engagement position of the second locating plate (40).

8. The seat adjuster as claimed in claim 7, wherein the locating frame includes a top wall and two lateral walls each having a top side extending from one of two opposite sides of the top wall and a bottom side pivotally connected with one of two opposite sides of the base;

the first locating plate is located between the base and one of the lateral walls of the locating frame.

9. The seat adjuster as claimed in claim 8, wherein the first locating plate is two in number and mounted with one of two opposite sides of the base, and the second locating plate is two in number and pivotally connected with one of the lateral walls of the locating frame.

10. The seat adjuster as claimed in claim 7, wherein the second locating plate has a guide slot, and the control rod has a transmission section received in the guide slot and pushing a periphery wall of the guide slot for driving the second locating plate to be pivotally moved from the first position to the second position.

11. The seat adjuster as claimed in claim 7, further comprising at least one torsion spring disposed between the locating frame and the second locating plate.

12. The seat adjuster as claimed in claim 7, further comprising a tension spring having two ends respectively connected with the locating frame and the control rod.

* * * * *